US006260791B1

(12) United States Patent
Seguin

(10) Patent No.: US 6,260,791 B1
(45) Date of Patent: Jul. 17, 2001

(54) FOLDABLE AND STACKABLE DEVICE FOR WINDING FLEXIBLE TUBULAR PIPES

(75) Inventor: Bruno Seguin, Nîmes (FR)

(73) Assignee: Coflexip (FR)

( * ) Notice: Subject to any disclaimer, the term of this patent is extended or adjusted under 35 U.S.C. 154(b) by 0 days.

(21) Appl. No.: 09/380,125

(22) PCT Filed: Nov. 23, 1998

(86) PCT No.: PCT/FR98/02499

§ 371 Date: Aug. 25, 1999

§ 102(e) Date: Aug. 25, 1999

(87) PCT Pub. No.: WO99/33738

PCT Pub. Date: Jul. 8, 1999

(30) Foreign Application Priority Data

Dec. 29, 1997 (FR) ..... 97 16 621

(51) Int. Cl.[7] ..... B65H 75/20

(52) U.S. Cl. ..... 242/604; 242/605; 242/606; 242/607.1; 242/608; 242/594.3; 242/597.7

(58) Field of Search ..... 242/602, 603, 242/605, 606, 607.1, 608, 614, 594.3, 597.7

(56) References Cited

U.S. PATENT DOCUMENTS

| | | | | |
|---|---|---|---|---|
| 30,064 | * | 9/1860 | Hemminway | 242/604 X |
| 430,419 | * | 9/1890 | Chamberlain | 242/597.7 X |
| 435,460 | * | 9/1890 | Shepard | 242/597.7 X |
| 483,830 | * | 10/1892 | Buchanan | 242/604 X |
| 1,262,446 | * | 4/1918 | Caron | 242/597.7 X |
| 1,611,625 | * | 12/1926 | Witscher | 242/604 X |
| 1,664,074 | * | 3/1928 | Heffernan | 242/607.1 |
| 2,300,869 | * | 11/1942 | Brandes, Jr. | 242/597.7 X |
| 2,476,176 | * | 7/1949 | Blanton | 242/604 X |
| 3,072,358 | * | 1/1963 | Knapp | 242/594.3 X |
| 3,667,510 | * | 6/1972 | Sattler | 242/603 X |
| 3,804,111 | | 4/1974 | Chatard et al. | 137/355.16 |
| 3,817,466 | | 6/1974 | Reynard et al. | 242/54 |
| 3,941,146 | | 3/1976 | Chatard et al. | 137/355.16 |
| 4,143,826 | * | 3/1979 | Lamperti | 242/597.7 X |
| 4,381,087 | * | 4/1983 | Williams | 242/604 X |
| 5,025,999 | * | 6/1991 | Littrell | 242/604 X |
| 5,547,147 | | 8/1996 | Pierre | 242/607.1 |
| 5,649,677 | | 7/1997 | Barney | 242/607.1 |

FOREIGN PATENT DOCUMENTS

| | | |
|---|---|---|
| 3536555 | 4/1987 | (DE) . |
| 0745549 | 12/1996 | (EP) . |
| 2698623 | 6/1994 | (FR) . |

* cited by examiner

*Primary Examiner*—Donald P. Walsh
*Assistant Examiner*—Minh-Chau Pham
(74) *Attorney, Agent, or Firm*—Ostrolenk, Faber, Gerb & Soffen, LLP

(57) ABSTRACT

A device for spooling flexible tubular pipe comprising at least one spooling wheel comprising a hub and spokes extending from the hub in a radial plane, wherein the spokes are articulated to the hub so that they can be folded towards the axis of the hub. The spokes may have several fold up articulations along their lengths.

9 Claims, 4 Drawing Sheets

FOLDABLE AND STACKABLE DEVICE FOR WINDING FLEXIBLE TUBULAR PIPES

BACKGROUND OF THE INVENTION

Foldable and stackable device for spooling flexible tubular pipes The present invention relates to a device for spooling flexible tubular pipes.

The pipes in question are, in particular, the pipes for conveying hydrocarbons laid under water from laying vessels. Such pipes are well known and may be continuous or made of sections connected together. Their rigidity varies and the term "flexible pipes" as used here is understood simply as meaning that they can be spooled into large-diameter reels without plastic deformation.

Flexible tubular pipes are produced in long lengths on land and have to then be transported to the laying site either directly on the laying vessel when the distance between the land-based yard and the laying site is not too great, or generally on an intermediate transport barge which takes them out to the laying vessel.

There are two known types of dockside and on-board containers for spooling the pipes, namely reels and carousels. A reel consists of a horizontal spooling axle held between two cheeks, all of a modest size (for example 9×9×5 $m^3$) and capacity (190 tons), while a carousel is defined by a large plate with a vertical-axis central spooling column, all of a very large size (for example 16 m radius) and capacity (2000 tons). While reels can be handled individually with relative ease, carousels cannot. Loading a pipe on board from the dockside is done in one of three ways: either by transporting reels (hereafter termed the reel-reel solution), or by transferring the pipe from dockside reels onto an on-board carousel (hereafter termed the reel-carousel solution), or by transferring the pipe from a dockside carousel onto an on-board carousel (hereafter termed the carousel-carousel solution).

The drawbacks of reels are, on the one hand, that their small diameter demands pipes which are fairly flexible (which allow relatively small minimum bend radius), and that their wound-up length not be too long. If the pipe is stored on board on reels (the reel-reel solution), then the total on board length is modest, and the cost of returning empty reels is high, given the amount of space that is lost. By contrast, the reel-reel solution is particularly flexible when loading dockside, and loading can be carried out quickly and safely.

In the reel-carousel solution, the total on-board length is greater, but the process of transferring reels to carousel is lengthy (which leads to boat downtime costs) and incurs risks of twisting the pipe. Furthermore, returning with the boat's carousel empty is expensive.

The carousel-carousel solution makes it possible to load on board pipes which are both considerably longer and possibly less flexible, although not only is the loading operation slow and inflexible, like in the previous instance, but risks of production coming to a complete standstill in the event of problems with spooling are not completely avoided. The problem of returning empty is not solved either.

Reels with two flanges connected by a hub, and of moderate size and partially foldable, are known in the context of the spooling and transporting of cables or the like. For example, patent FR 2 698 623 A discloses a reel with two flanges, the specific feature of which is that the flanges can be folded along a chord. In documents U.S. Pat. No. 5,649,677 A, U.S. Pat. No. 5,547,147 A, EP 0 745 549 A or DE 35 36555 A, on the other hand, it is the hub which is foldable. These solutions, which at best provide quite a small saving of space in the radial direction of the flanges, cannot be read across to the field of the large-size reels and carousels to which the invention relates.

SUMMARY OF THE INVENTION

The purpose of the invention is to develop a possibility for transporting pipes using a more suitable spooling device, which avoids most of the drawbacks of the known solutions without losing their advantages.

According to the invention, there is proposed a device for spooling flexible tubular pipe, of the type comprising at least one spooling wheel consisting of a spooling hub and of spokes extending from the hub in a radial plane, wherein the spokes are articulated to the hub so that they can be folded towards the axis of the hub, which makes it possible to considerably reduce the volume of the wheel when empty.

Advantageously, each spoke comprises, along its length, one or more articulations allowing it to be folded up on itself, which further reduces the volume of the wheel when empty.

Advantageously, each spoke comprises two branched articulated parts which, when deployed in the said radial plane, can give a different very large capacity for spooling.

The wheels of the invention can be stacked on an existing ship carousel, but according to a very advantageous aspect of the invention, several wheels are associated with a special-purpose stacking pallet placed on the deck of the boat, which pallet may or may not comprise a column for centering the spooling wheels. The pallet is preferably motorized to allow the flexible pipe to be paid out in the same way as with a conventional carousel.

It is advantageous for the hub of the wheels to be self-stacking. It is also advantageous for the hub of the wheels to have a size which, after the arms have been folded, allows the wheel to be transported in a standard size container. It is also advantageous for there to be at least one inner, preferably radially adjustable, and/or outer spooling stop on the arms.

By virtue of these features it is possible for the spooling wheels to be handled individually using dockside cranes or on-board cranes with the same speed, modularity and flexibility as with conventional reels, but without being in any way limited in terms of flexibility, because the wheels may have a diameter of the order of that of a conventional carousel rather than that of a reel. The wheels with their spooling are stacked on board on the associated pallet and form a carousel with advantages similar to those of a conventional carousel.

BRIEF DESCRIPTION OF THE DRAWINGS

Other features and advantages of the invention will become clear from reading the following description of a number of embodiments, with reference to the appended drawings, in which.

DESCRIPTION OF THE PREFERRED EMBODIMENTS

Figure 1:
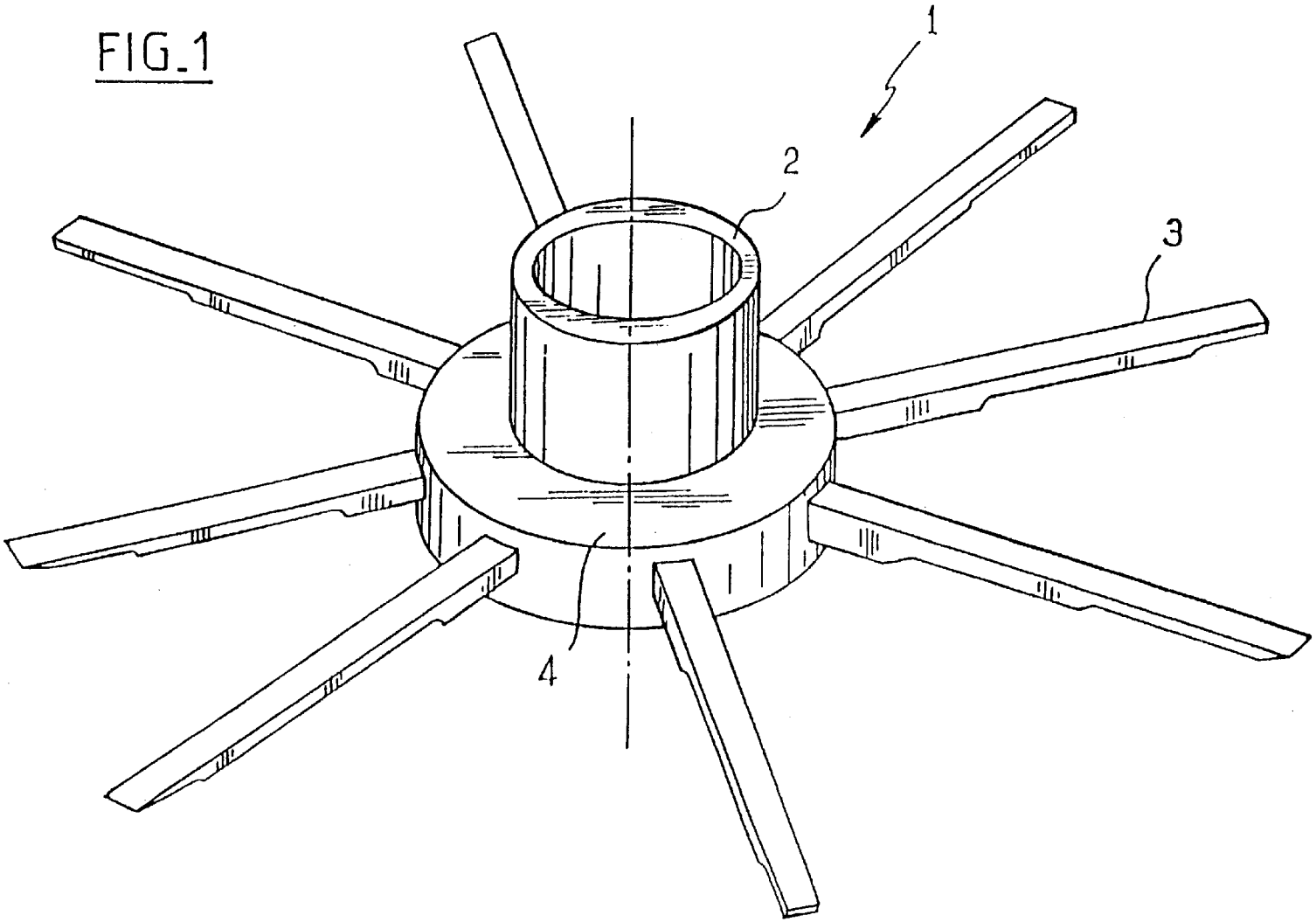
FIG. 1 is a diagrammatic perspective view of a wheel in accordance with the invention.

FIG. 1 shows a wheel or spider 1 made up of a cylindrical hub 2 about which a number of radial arms or spokes 3 extend in a radial plane. The spokes are connected to the hub 2 by an articulation which will be detailed later, possibly located on a collar 4 surrounding part of the hub 2. The spokes 3 are intended to support a spooling of flexible pipe (shown by the reference 14 in FIG. 2); to lighten the structure, it is possible (as depicted in FIG. 1) to construct the cross section of the spokes to decrease, uniformly or stepwise, as they get further away from the hub 2, and as the cross section of the spoke is subjected to lower load because of the lower number of turns supported.

Figure 2:
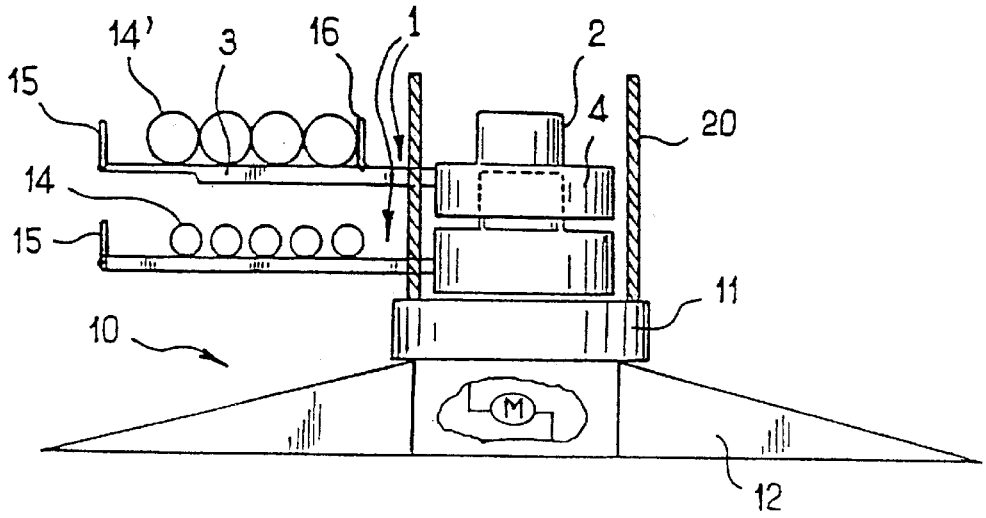
FIG. 2 is diagrammatic side view of a special-purpose pallet for stacking wheels in accordance with the invention.

As FIG. 2 shows, a collection of spiders 1 is associated with a pallet 10 consisting of a base 11 motorized at M to rotate with respect to a plinth 12 placed on the deck of the boat. The base 11 could comprise a centering column over which the hubs 2 of the stacked spiders can be slipped, but the hubs are preferably self-stacking, as described later. The base 11 comprises, spaced apart circumferentially about its periphery, removable vertical bars 20 which (cf. also FIG. 5) sit between the arms 3 of the spiders 1. The bars 20 lie on a cylinder enveloping the cylinder consisting of the stack of hubs 2 and collars 4. The bars 20 serve to guide the stack, and also ensure that the stack is stable at sea. In addition, as the base 11 turns, the bars 20 may contribute to causing the superposed spiders to rotate.

FIG. 2 depicts two superposed spiders, but naturally more could be envisaged. Each spider 1 may have one or more successively wound or superposed lengths of pipe 14. The pipes may have different diameters. Thus, depicted on the upper spider is a pipe 14' of greater diameter than the pipe 14; to take account of the fact that the minimum bend radius it can have without deformation is larger, inner spooling stops 16 defining the minimum spooling diameter are placed on the spokes 3 of the upper spider. These stops 16 may be welded to the spokes 3 or be designed to slide and retract on the spokes. Likewise, there may be outer spooling stops 15 at the end of the spokes 3, these preferably being retractable by virtue of appropriate articulation.

Figure 3:
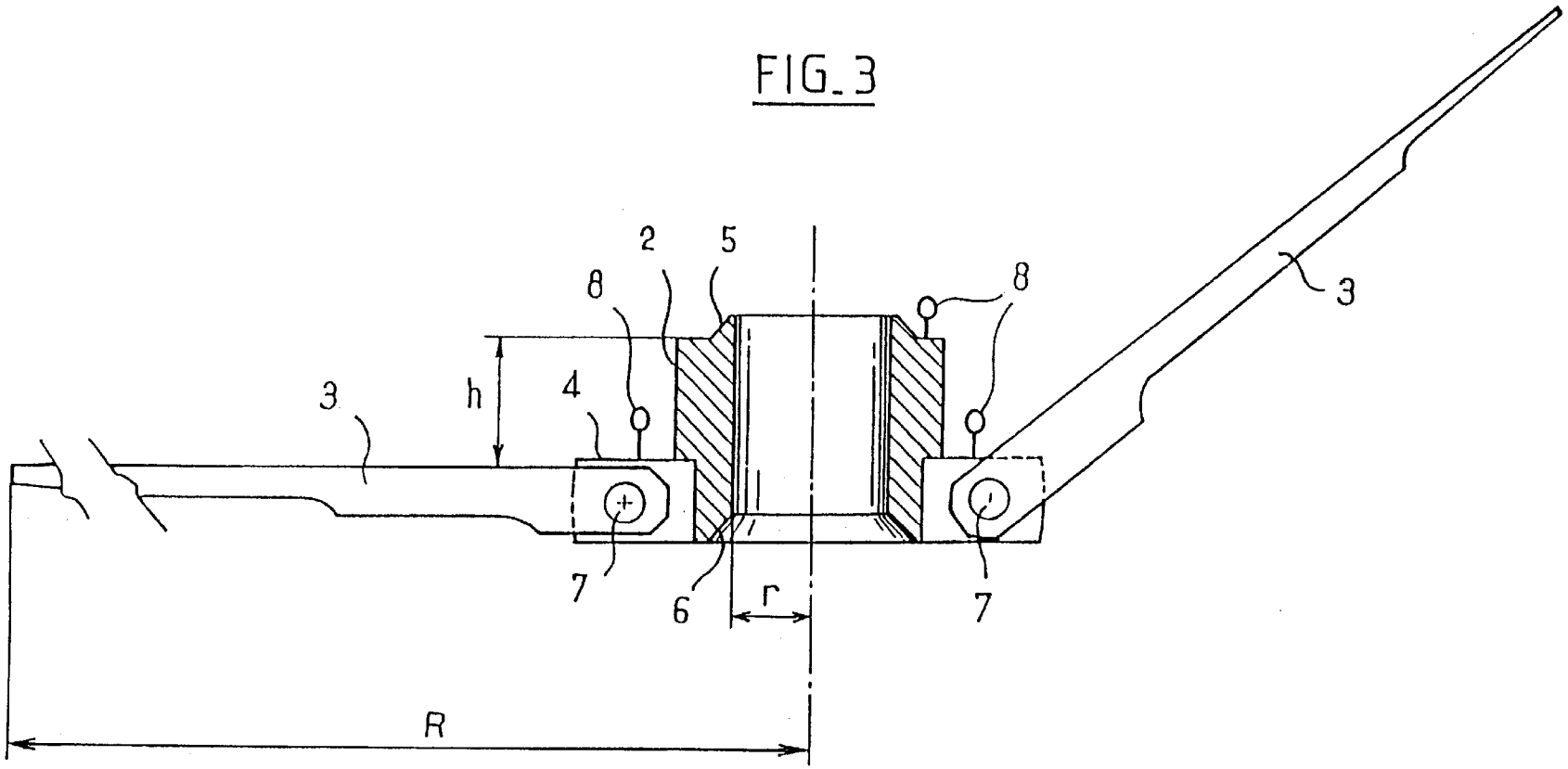
FIG. 3 is a side view in partial section of one embodiment of a wheel.

FIG. 3 in particular illustrates one embodiment of self-stacking hubs 2; at their upper and lower parts these hubs have self-centering complementary nesting shapes 5 and 6, particularly conical bearing surfaces. This figure also shows the articulation 7 between the spokes 3 and the collar 4 surrounding the hub. These articulations are designed to lock so that the deployed arms of the spider can remain in a vertical plane. There may be lifting eyes 8 on the collar 4 (or elsewhere provided that they do not impede the stacking of several spiders), so that the spiders can be handled.

Figure 2A:
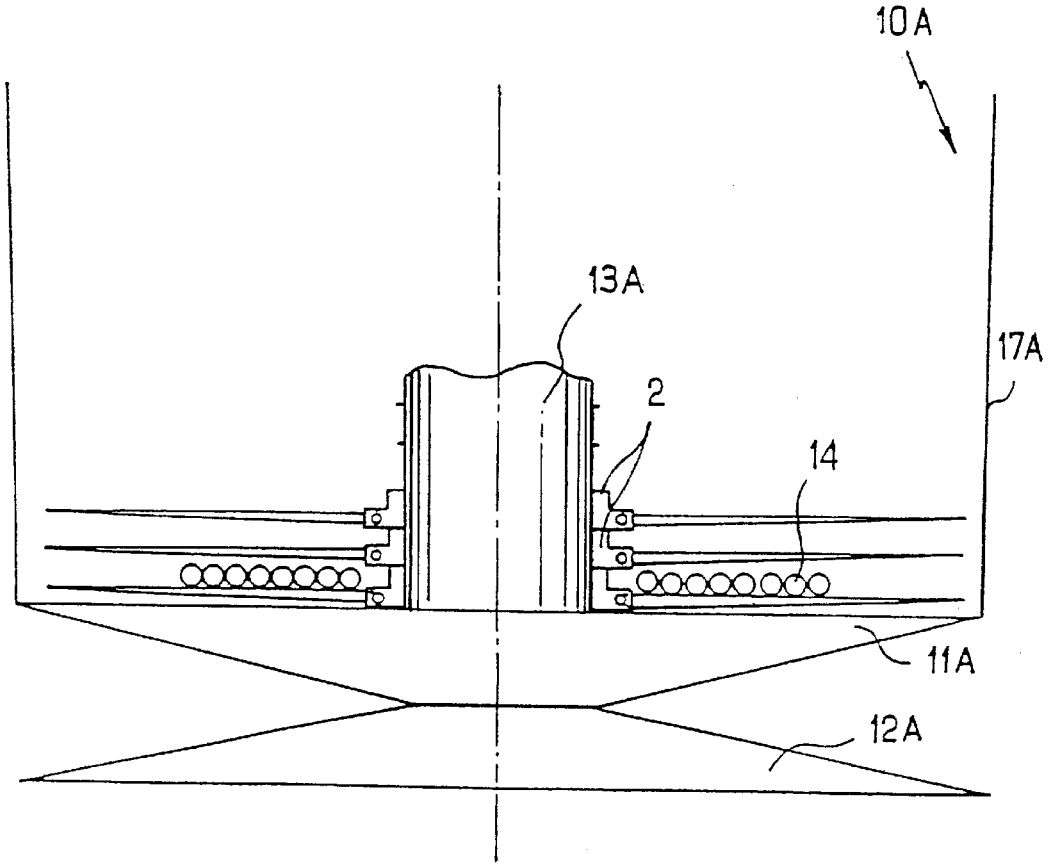
FIG. 2A is a diagrammatic view of the stack of wheels in accordance with the invention on a conventional ship carousel.

In an alternative form of the invention, the spiders are stacked not onto a special-purpose pallet 10, but this time onto an existing carousel 10A depicted in FIG. 2A with its plinth 12A on which is mounted the large turntable 11A, which has a central column 13A and an outer cage 17A.

The respective dimensions of the various elements that make up a spider have not been observed in the drawings and differ depending on whether they are being used on a carousel or on a special-purpose pallet. As an indication of an order of magnitude, the inside radius r of the hub 2 used on a carousel may be 3 m, while the radius R of a deployed arm may be from 7 to 10 m, for example. The height h available between the top of the radial plane formed by the deployed arms 3 of one spider and the spider on top is at least 0.65 m so as to allow the spooling of pipes of this diameter. In the case of a spider used on the special-purpose pallet 10, it is preferable to reduce the radius of the hub 2 to 1.10 m, so that once the arms have been folded, the spider can fit into a standard size container ($2.2\times2.2\times5.5$ $m^3$), which makes it easier to return empty.

Figure 4:
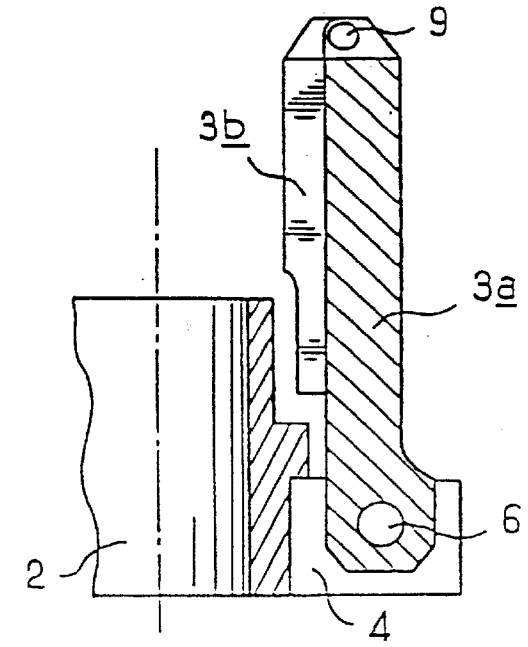
FIG. 4 is a partial side view with partial section of another embodiment of a wheel.

FIG. 4 shows another embodiment in which the arm 3 consists of two parts 3*a*, 3*b* articulated together by an articulation 9, allowing the radially outermost part 3*a* of the arm to fold down along the radially innermost part 3*b* of the arm, which is itself depicted in its position in which it is folded parallel to the axis of the hub 2.

Folded spiders (particularly in the case of spiders for a carousel) can be stacked by offsetting the folded arms by a certain angle from one spider to the next. Alternatively, it may be preferable for the arms 3 not to be folded completely parallel to the axis of the hub, but to be folded at an oblique angle compatible with stacking.

Figure 5:
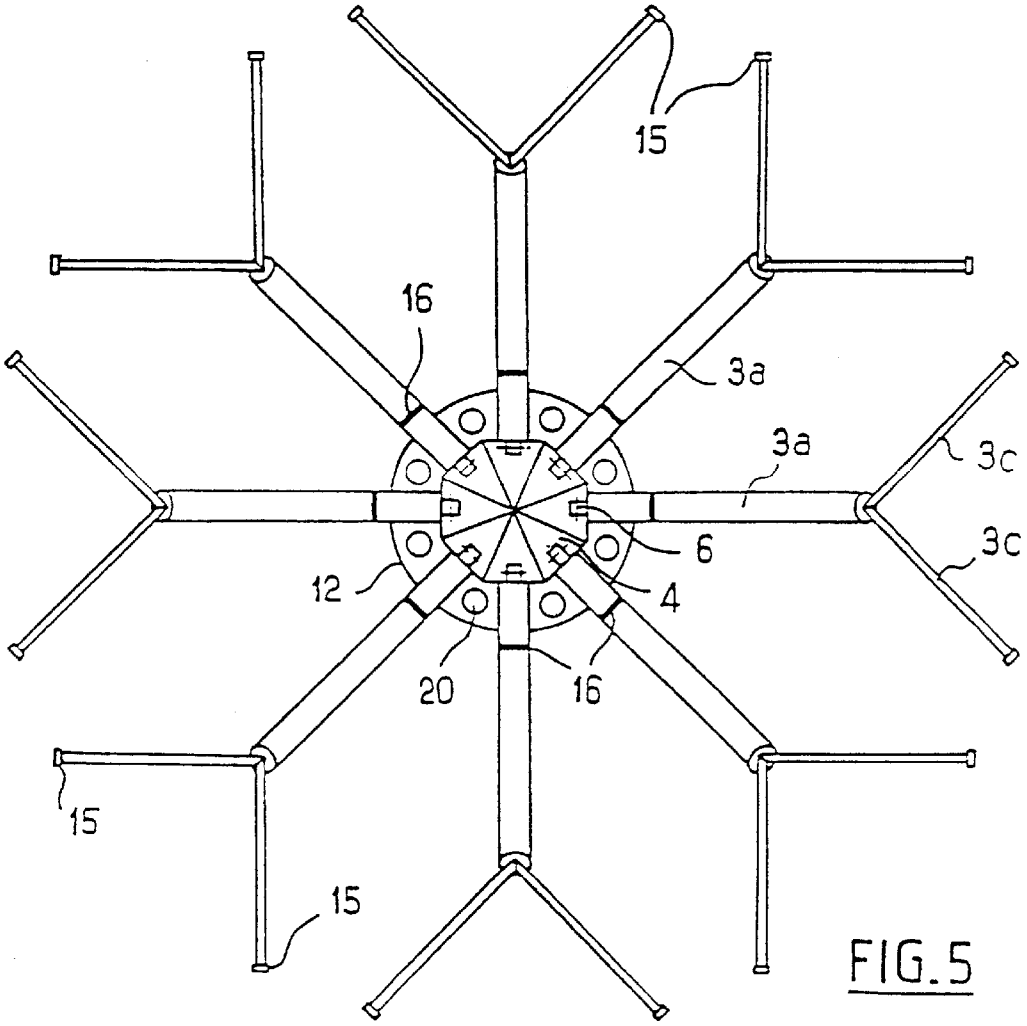
FIG. 5 is a view from above of a third embodiment of a wheel.

The version shown in FIG. 5 differs by the fact that the arms 3 comprise a first radially innermost part 3*a*, to the end of which are articulated two branched parts 3*c* capable of adopting two distinct positions in the radial spooling-support plane: a deployed position as depicted in solid line, in which the parts 3*c* obliquely extend the radial parts 3*a* and extend the spooling capacity to its maximum (for example 2000 tons in the case of a complete five-wheeled pallet), and a position in which they are retracted or folded along the parts 3*a*, which corresponds to a lower spooling capacity (for example 900 tons for the complete pallet). It will be seen that in their deployed position, the branched parts 3*c* allow the length of the wound arcs of pipe between two support parts 3*c* to be kept at a value which does not give rise to undesirable sagging of the pipe between supports.

Various modifications may be envisaged without departing from the scope of the invention. It may be envisaged for the parts 3*c* to be retractable inside the parts 3*a* when the spiders are returned empty. The arms 3 may have spooling stops 15 and 16, possibly foldable. The inner stop 16 is advantageously adjustable in terms of radial position so that the diameter at which the pipe is wound can be adjusted.

What is claimed is:

1. Device for spooling flexible tubular pipe comprising a spooling wheel comprising a hub and spokes extending out from the hub in a radial plane, wherein the hub has a top portion and a bottom portion which are complementary in shape to enable the hub of the spooling wheel to nest with a hub of another spooling wheel, such that the spooling wheel is self-stacking with other like spooling wheels, and wherein the spokes are articulated to the hub for enabling the spokes to be folded toward the axis of the hub.

2. Spooling device according to claim 1, wherein each spoke comprises, along its length, at least one articulation allowing the spoke to be folded up on itself.

3. Spooling device according to claim 1, wherein each spoke comprises two branched articulated parts along its length.

4. Spooling device according to claim 1, further comprising a stacking pallet and a plurality of the spooling wheels stacked on the stacking pallet.

5. Spooling device according to claim 4, wherein the stacking pallet comprises a column for centering the spooling wheels.

6. Spooling device according to claim 4, wherein the stacking pallet is motorized to rotate.

7. Spooling device according to claim 1, further comprising at least one radially inner or outer spooling stop on each of the spokes.

8. Spooling device according to claim 7, wherein there is at least one radially adjustable inner spooling stop on the spokes.

9. Device for spooling flexible tubular pipe, comprising:

a stacking pallet having a rotatable base element; and a plurality of stackable spooling wheels, each wheel comprising a hub shaped to be both removably engageable on the base element of the pallet and nestingly stackable on the hub of another one of the spooling wheels, and spokes arrayed around the hub and also articulated to the hub for enabling the spokes to move between a first position in a radial horizontal plane for receiving a horizontal layer of wound pipe and a second position folded toward the axis of the hub and substantially parallel with the axis of the hub.

* * * * *